US010307934B2

(12) United States Patent
Haenel et al.

(10) Patent No.: US 10,307,934 B2
(45) Date of Patent: Jun. 4, 2019

(54) DECORATIVE WOOD-BASED BOARD PANEL AND METHOD OF PANEL PRODUCTION

(71) Applicant: Kronospan Technical Co., Ltd., Nicosia (CY)

(72) Inventors: Winfried Haenel, Dresden (DE); Tino Schulz, Dresden (DE)

(73) Assignee: Xylo Technologies AG (CH)

( * ) Notice: Subject to any disclaimer, the term of this patent is extended or adjusted under 35 U.S.C. 154(b) by 560 days.

(21) Appl. No.: 14/473,165

(22) Filed: Aug. 29, 2014

(65) Prior Publication Data

US 2014/0367880 A1 Dec. 18, 2014

Related U.S. Application Data

(62) Division of application No. 11/996,215, filed as application No. PCT/DE2006/001248 on Jul. 17, 2006, now abandoned.

(30) Foreign Application Priority Data

Jul. 19, 2005 (DE) ..... 10 2005 034856

(51) Int. Cl.

| | |
|---|---|
| ***B27N 3/06*** | (2006.01) |
| ***B44C 5/04*** | (2006.01) |
| ***B44C 1/10*** | (2006.01) |
| ***B44C 1/18*** | (2006.01) |
| ***B27N 3/02*** | (2006.01) |
| ***B27N 3/12*** | (2006.01) |

(52) U.S. Cl.
CPC ..... *B27N 3/06* (2013.01); *B27N 3/02* (2013.01); *B27N 3/12* (2013.01); *B44C 1/10* (2013.01); *B44C 1/18* (2013.01); *B44C 5/043* (2013.01); *Y10T 428/24372* (2015.01)

(58) Field of Classification Search
USPC ..... 264/73, 74
See application file for complete search history.

(56) References Cited

U.S. PATENT DOCUMENTS

| | | | | |
|---|---|---|---|---|
| 3,887,415 A * | 6/1975 | Elmendorf | B44C 5/043 | 156/154 |
| 4,109,041 A * | 8/1978 | Tellman | B32B 21/12 | 156/279 |
| 4,163,813 A * | 8/1979 | Sheets | B05D 5/06 | 101/491 |
| 4,181,711 A * | 1/1980 | Ohashi | E04B 1/6812 | 428/40.6 |

(Continued)

*Primary Examiner* — Jacob T Minskey
*Assistant Examiner* — Baileigh Kate Darnell
(74) *Attorney, Agent, or Firm* — Jeffrey Joyce; Patricia Mathers

(57) ABSTRACT

A manufactured wood-based panel for furniture and interior construction. Particle sized foreign materials are irregularly distributed under a protective layer over one or both of the surfaces of the wood-based panel, covering more than 10% of the panel surface. The foreign materials, preferably natural materials such as cork or hemp shives, but also plastics, metal particles, or recycled material are incorporated so that they either protrude from the panel surface to form a relief pattern or are embedded in the wood-based material to form a uniform, smooth panel surface.

7 Claims, 2 Drawing Sheets

(56) References Cited

U.S. PATENT DOCUMENTS

| | | | | | |
|---|---|---|---|---|---|
| 4,698,010 | A * | 10/1987 | Toncelli | B28B 3/022 | 186/61 |
| 5,130,072 | A * | 7/1992 | Hemels | C08G 8/04 | 156/335 |
| 2001/0021447 | A1* | 9/2001 | Willemse | B29C 43/003 | 428/220 |
| 2002/0155279 | A1* | 10/2002 | Dai | B27N 3/06 | 428/335 |
| 2004/0142107 | A1* | 7/2004 | Eriksson | B05D 5/061 | 427/258 |

* cited by examiner

DECORATIVE WOOD-BASED BOARD PANEL AND METHOD OF PANEL PRODUCTION

BACKGROUND INFORMATION

Field of the Invention

The invention relates to a panel-like, manufactured wood-based material for furniture and interior construction, offering attractive, decorative alternatives to conventionally applied finishes in numerous possible variations.

Description of the Prior Art

Wood-based materials, such as chip or particle board, oriented-strand board (OSB) or board featuring a homogeneous structure in all directions and known as high-density fiber board (HDF) or medium-density fiber board (MDF) are by far the most widely used materials in furniture and interior construction, as well as in construction for trade shows, theater stage scenery, and small shops. The panels, which contain wood shavings or wood fibers or both, are typically produced in a dry process and a binder that is adapted to the final intended use of the panels is generally added during production. Special additives may impart properties to the material, such as reduced water absorption and, thus, reduced thickness swelling, low flammability and/or a certain resistance to biological pests and environmental damage.

These wood-based board products provide advantages for their particular application. Particle board and MDF board panels, however, have a distinctly unattractive surfaces, and, for this reason, are usually faced or coated with other materials, preferably veneers, synthetic materials, and varnishes. Recently, manufacturers have succeeded in manufacturing MDF that is imbued or colored all the way through, with very good reproducibility of all quality parameters (see on the Internet: MASTERWOOD black, from the company Hornitex; TOPAN black/brown, from the company Glunz; TOPAN color FF from the company BASF/Glunz). The melanine resin-coated Hornitex product "M.D.F. Masterwood black", for example, is considered a high-value substitute for solid wood and a base material for surface treatments which had previously been done very little, such as direct varnishing, foiling, coating, encasing, and veneering, whereby now the decorative bond between foil and melamine from the front and rear faces up to the corpus, edge and layer material is now ensured.

This through-colored MDF, however, satisfies only to a limited degree the requirements of architects and designers, to show the inherent structure of the material, without subsequent decorative coating, and to let the material itself have an effect. Constant progress has been made in recent years in this regard with OSB (oriented strand board), which was introduced into Europe at the beginning of the 90s. These multi-layer panels, made with 12 cm long, slender, longitudinally oriented strands of a pre-defined form and thickness, stand out, not only because of their higher bending strength compared to standard flat-pressed boards (particle boards), but also because of a characteristic appearance which is due to the bonding and strand structure. Owing to its "woody" appearance, the typical OSB structure (large-surface structure of the wood shavings) is appreciated as a decorative element.

Furthermore, in recent times the surfaces of the OSB panels are also being dyed (see on the Internet: Agepan OSB color, from the company Glunz; Eurostrand OSB Dekorativ, from the company Egger). The uniform areal coverage after multiple applications of UV special varnishes or paints is just intense enough to clearly emphasize overall the chosen color, on the one hand, but on the other hand, is done intentionally to not blot out the random beauty of the long strands. The strands must be light in color, however, for the board material to show this desired important effect.

U.S. Pat. No. 4,109,041 discloses a construction panel in which elastomeric particles, preferably rubber grindings and buffings produced in vehicular tire manufacturing and recapping operations, are incorporated into at least one surface of particle board panels. It is the objective of the invention to increase the roughness of the panel surface, so that they can be stacked without problem, tools can be safely placed on such panels, and to increase safety when stepping on these panels. The addition of elastomeric particles also creates (unintentionally) a new, decorative construction panel that differs from the conventional structure of particle board panels. It is essential that the structure of the panel surface be smooth and, in particular, that the elastomeric particles be uniformly distributed. Thus this "decorative" panel, which was exclusively developed for use as a construction panel with a non-skid property, can by no means meet the above-mentioned requirements for a decorative wood-based panel intended for furniture and interior construction purposes.

Furthermore, U.S. Pat. No. 3,887,415 discloses a wood-based panel, which has a protective layer made of bark shavings. Its surface is harder than the natural, weathered bark of a tree and gives the panel a marbled and structured surface with a decorative appearance. Essential to the invention is that the bark shavings be bonded under pressure to form a single layer of material, which is then sanded to remove any projections. Overall, the effort required to make such a panel is comparatively high, because it requires a two-stage process. Consequently, this proposal has remained prior art on paper.

The prior art for decorative wood-based panels that are usable without facings is, thus, in practice defined by the surface color treatment with OSB and the smooth single-color construction of through-colored MDF. Both methods, despite their advantages, are resource-intensive and costly. Unfaced wood-based panel materials featuring a decoratively structured surfaces that exceed the (moderately satisfactory) effects achieved by means of light-colored strands, are not known. The solutions described in the above-mentioned US patents either do not satisfy the aesthetic requirements because they were developed for other purposes (U.S. Pat. No. 4,109,041), or they permit a bark-type decoration only (U.S. Pat. No. 3,887,415). Furthermore, they are technologically very resource-intensive.

BRIEF SUMMARY OF THE INVENTION

It is an object of the invention, therefore, to sustainably improve the decorative properties of unfaced wood-based panels. Particularly, it is an object to provide a relatively cost-effective method of manufacturing such unfaced wood-based panels.

The object is achieved by providing a wood-based panel that has particles or small-sized pieces of foreign material incorporated into the outer surface of the panel and a method of producing the same. The panel is produced in a primary forming process, whereby the particles are embedded in the outermost layer of the panel. The particles are distributed irregularly across the surface, covering between 10% and 75% of the surface. The surface is then coated with a transparent protective coating.

According to the invention, foreign material is distributed across or incorporate into or onto the uppermost layer of a non-woven or random mat or fleece comprising particle or fiber. Using conventional panel formation process, the panel is then pressed to form a panel with a decorative panel surface. Depending on the material used, the panel surface structure may be constructed as a surface with a relief pattern, or as a smooth surface. For the relief pattern, materials are used that have a high degree of resilience; in the other case, materials are chosen which are not, or are only negligibly, resilient. The thus obtained decorative structure may be applied according to the invention to one side or both sides of the panel. It was an unexpected discovery to find out that such foreign materials may be used almost exclusively without any adhesives and that they bond well in the panel material.

Furthermore, it is intended that, within the scope of the invention, these foreign materials be covered by a transparent protective coat, e.g. a clear varnish (liquid paint, scumble, powder coat, dry coat).

Preferably, the foreign material is a natural material. Cork, for example, is used to obtain a raised texture, whereas hemp shives are used to obtain a smooth panel surface.

Other natural materials, such as straw, tree needles, natural fibers and through-colored OSB strands may be used. These materials also provide good adhesion, in consideration of pleasant appearance, together with optimal technical ratings. Leaves, twigs, branches and, wool, too, may also be used to advantage. Screenings or fractions of these materials, i.e., materials that have been screened according to size, may, of course, also be used.

It is also within the scope of the invention that plastics, metal or recycled material, for example, plastic granulate, metal powder, metal foil, metal chips, or paper in the form of hole-punch residue, may be used as the foreign material.

The board materials so produced have a highly decorative, structured surface so that their use is especially suitable for the type of applications referred to at the beginning (in particular, furniture production and interior finish purposes), which are intended to present a good appearance or relate to the environment.

BRIEF DESCRIPTION OF THE DRAWINGS

Two embodiments of the invention will be described below in more detail, based on the following illustrations.

DETAILED DESCRIPTION OF THE INVENTION

A non-woven or random particle mat or fleece is formed of wood shavings and adhesive in a process that is long known in the industry and often referred to as a primary forming process. According to the invention, evenly and through-dyed hemp shives are distributed over the upper surface of this particle mat.

Thereafter, the particle mat, inclusive of the through-colored hemp shive particles that were applied to the mat, is first pre-compacted at ambient temperature and then delivered into a hot press. In the press, the so structured wood-based material is subjected to a conventional hot press process. Depending on the desired board thickness, raw density and board properties, the mat and the incorporated through-colored hemp shive particles are compressed at defined pressures and temperatures, whereby the glue-free hemp shive particles become interlaced or meshed with the wood shavings and glue of the mat.

Following the hot press process, the board so produced is conditioned in a stack, then sanded and sealed with clear varnish.

The particle board panel thus produced has on one side a color-structured, attractively decorated surface that is smooth and is immediately ready for use after the-protective coat is applied.

Figure 1:
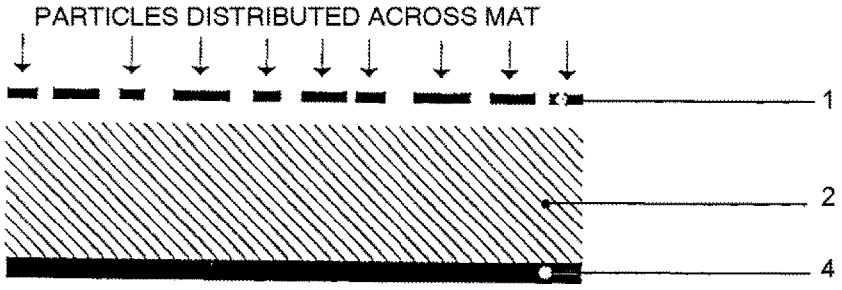
FIG. 1 illustrates a first step in the production of a first embodiment of a decorative wood-based panel according to the invention, in which particles of foreign material are being placed on the uppermost surface of a mat of non-woven fiber or chip material.
Figure 2:
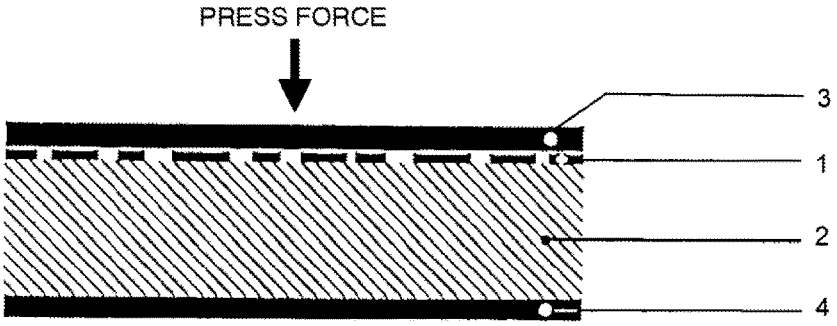
FIG. 2 illustrates a second step, in which an upper press surface is placed over the mat and foreign material.
Figure 3:
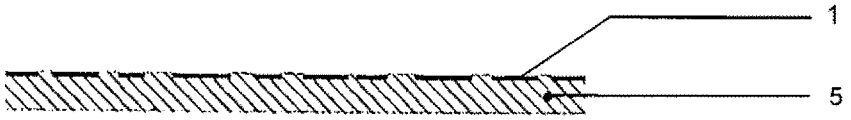
FIG. 3 illustrates a decorative wood-based panel according to the invention, having a smooth surface.

FIGS. 1 to 3 illustrate the manufacture of a first embodiment of a decorative wood-based panel according to the invention. FIG. 1 shows a random mat or fleece 2 comprising panel particles, such as wood shavings, placed on a lower press plate or surface 4. Decorative particles 1 of foreign material are distributed irregularly across the uppermost surface of the non-woven mat 2. In this embodiment, the decorative particles are through-colored hemp shives. FIG. 2 shows an upper press plate or surface 3 being lowered onto the mat 2 and the decorative particles 1. The arrangement is then subjected to a hot-press process that is conventionally used in the manufacture of panels. FIG. 3 shows the decorative wood-based panel following the hot-press step, whereby decorative particles 1 have been embedded into the mat 2, such that the resulting panel has a smooth panel surface 5.

In the second embodiment, which is also based on the conventional process traditionally applied in industry, first, a fiber mat of wood-based material is made, to which glue is applied.

According to the invention, a coarse cork granulate is evenly spread over the upper surface of the fiber mat. Thereafter, the fiber mat and cork granulate that was applied to the mat are first pre-compacted at ambient temperature and then delivered to a hot press, whereby they are compressed in a way analogous to that described above, with the result that the preferably glue-free cork particles are interlaced or meshed with the wood shavings to which glue was applied.

Following the hot-press process, the boards so produced are stacked and conditioned.

When the press is opened, the cork granulates, due to the high elasticity of cork and its inherently high degree of resilience, return to their original form to a great extent, and, as a result, protrude from the otherwise plane board. The fiber panel so produced has a structured, attractive, decorative surface with a relief pattern on one side, and is immediately ready for use after the application of a protective coat, which here, too, is preferably a clear varnish.

Figure 4:
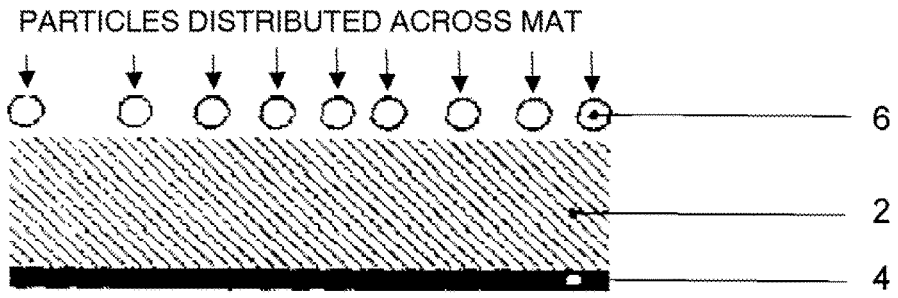
FIG. 4 illustrates a first step in the production of a second embodiment of a decorative wood-based panel according to the invention, in which particles of foreign material are being placed on the uppermost surface of a mat of non-woven fiber or chip material.
Figure 5:
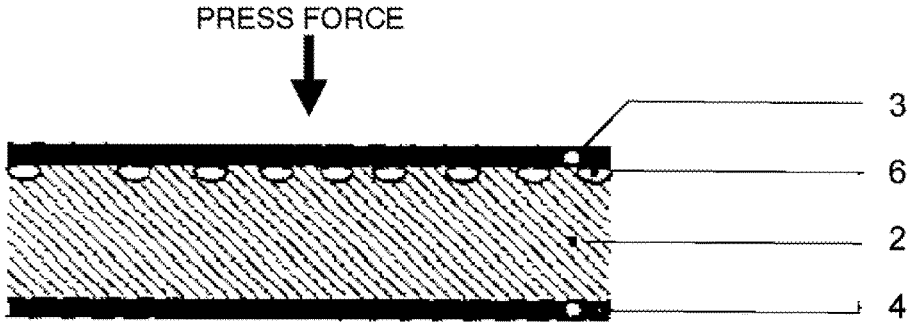
FIG. 5 illustrates a second step, in which an upper press surface is placed over the mat and foreign material.
Figure 6:
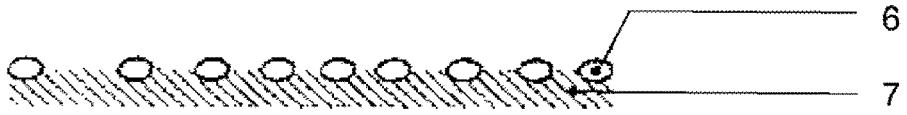
FIG. 6 illustrates a decorative wood-based panel according to the invention, having a textured or raised surface.

FIGS. 4 to 6 illustrate the manufacture of a second embodiment of the decorative wood-based panels according to the invention. FIG. 4 shows a particle mat 2 comprising a wood fiber fleece, placed on the lower press plate 4. Decorative particles 6 are being distributed irregularly across the uppermost surface of the mat 2. In this embodiment, the decorative particles 6 have a resilience to retain their shape. FIG. 5 shows the upper press plate 3 lowered onto the mat 2 and the decorative particles 6. FIG. 6 shows the decorative wood-based panel following the hot-press step, whereby decorative particles 6 have been captured in the mat 2, but have retained their shape to some extent, such that the resulting panel has a textured or relief-patterned surface 7.

It is understood that the embodiments described herein are merely illustrative of the present invention. Variations in the construction of the wood-based decorative panel may be contemplated by one skilled in the art without limiting the intended scope of the invention herein disclosed and as defined by the following claims.

What is claimed is:

1. A method for producing a decorative wood-based panel, the method comprising the steps of:

a) making a fiber mat of fibers from a wood-based material to which fibers a glue is applied, the fiber mat having an upper and a lower surface, wherein said lower surface of said fiber mat is placed on a lower press plate;

b) spreading non-fire retardant particles of foreign materials over the upper surface of the fiber mat, the foreign materials being natural or plastic material, wherein the foreign materials are irregularly distributed relative to each other;

c) pre-compacting the fiber mat and the foreign materials at ambient temperature by lowering an upper press plate onto the upper surface of the fiber mat and the foreign materials;

d) forming a board by subjecting the fiber mat and the foreign materials to a hot press process, whereby the non-fire retardant particles are cross-linked with the wood-based material; and e) sealing the board with clear varnish.

2. The method of claim 1, wherein the wood-based panel has an uppermost layer that includes a panel surface, and wherein the foreign materials are irregularly distributed relative to each other to cover 25% to 75% of the panel surface and are embedded exclusively in the uppermost layer of the panel.

3. The method of claim 1, wherein the foreign materials are used for producing a relief-patterned surface structure on the panel surface and are materials with a high resilience.

4. The method of claim 1, wherein the foreign materials are cork.

5. The method of claim 1, wherein the foreign materials are used to produce a smooth surface structure on the panel surface and are materials of no resilience at all, or of a negligible resilience.

6. The method of claim 5, wherein through-dyed hemp shives are used as the foreign materials.

7. The method of claim 1, wherein the panel surface includes an upper surface and a lower surface and the foreign materials are spread on both surfaces.

* * * * *